US006209811B1

(12) United States Patent
Tippet, Sr.

(10) Patent No.: US 6,209,811 B1
(45) Date of Patent: Apr. 3, 2001

(54) ROLLER-STATOR DISPERSER

(76) Inventor: Jerome Paul Tippet, Sr., 745 Pinellas Bayway #102, Tierra Verde, FL (US) 33715

( * ) Notice: Subject to any disclaimer, the term of this patent is extended or adjusted under 35 U.S.C. 154(b) by 0 days.

(21) Appl. No.: 09/439,823

(22) Filed: Nov. 12, 1999

(51) Int. Cl.[7] ..... B02C 15/08
(52) U.S. Cl. ..... 241/46.15; 241/131
(58) Field of Search ..... 241/46.017, 46.04, 241/46.15, 110, 126, 131, 132, 133

(56) References Cited

U.S. PATENT DOCUMENTS

| | | | | |
|---|---|---|---|---|
| 859,118 | * | 7/1907 | Schieffler | 241/131 |
| 2,115,314 | * | 4/1938 | McErlean | 241/46.15 |
| 2,413,793 | * | 1/1947 | Sharp | 241/46.15 |
| 3,027,103 | * | 3/1962 | Mischanski | 241/131 |
| 3,135,474 | | 6/1964 | Schold . | |
| 3,653,600 | | 4/1972 | Schold . | |
| 3,844,490 | | 10/1974 | Schold et al. . | |
| 4,044,957 | | 8/1977 | Schold . | |
| 4,197,019 | | 4/1980 | Schold . | |
| 4,394,981 | | 7/1983 | Schold . | |
| 4,854,720 | | 8/1989 | Schold . | |
| 5,156,344 | | 10/1992 | Tippett . | |
| 5,785,262 | | 7/1998 | Tippett . | |
| 6,003,439 | * | 12/1999 | Knezek et al. | 241/46.15 |

FOREIGN PATENT DOCUMENTS

| | | | | |
|---|---|---|---|---|
| 1187850 | | 5/1985 | (CA) . | |
| 188999 | * | 10/1907 | (DE) | 241/46.15 |

OTHER PUBLICATIONS

Schold Welding & Machine Co. "Schold Dispersers".

* cited by examiner

*Primary Examiner*—Mark Rosenbaum
(74) *Attorney, Agent, or Firm*—Trexler, Bushnell, Giangiorgi, Blackstone & Marr, Ltd.

(57) ABSTRACT

An apparatus is provided for dispersing solid particles carried in suspension in a liquid medium. The apparatus includes a mounting frame, a rotatable agitator shaft connected thereto, a drive assembly carried thereby for rotating the agitator shaft, and a roller-stator assembly carried by the mounting frame. The roller-stator assembly includes a roller assembly and a stator assembly. The stator assembly includes a plurality of stator support rods extending from the mounting frame and a stator ring attached to the stator support rods. The roller assembly is connected to the agitator shaft and is positioned within the stator ring. The roller assembly includes a plurality of upper and lower roller support portions which form pairs and each of which has roller positioned therebetween which is rotatable with respect to the pair and with respect to the stator ring. As the roller assembly is rotated within the stator assembly, the solid particles within the liquid medium are ground as the rollers roll over a film of slurry on the inner wall of the stator ring.

17 Claims, 10 Drawing Sheets

ROLLER-STATOR DISPERSER

BACKGROUND OF THE INVENTION

This invention is generally directed to a dispersing apparatus for dispersing solid particles in a liquid medium.

A prior art "fluid energy" disperser is shown and described in U.S. Pat. No. 5,156,344. This prior art disperser utilizes a rotor assembly mounted within a stator assembly to disperse solid particles within a liquid medium. The rotor assembly is rotated within the stator assembly to disperse the solid particles within the liquid medium.

A prior art "mechanical energy" shot mill disperser is shown and described in U.S. Pat. No. 3,653,600. This prior art disperser utilizes steel shot which is retained in a mixing vessel and agitated by rotating impellers connected to a drive shaft to disperse the solid particles within the liquid medium. The apparatus has a rotor separator device connected to and driven by the drive shaft near the mixing vessel outlet to separate the steel shot from the finished product.

At times, it is desired to grind pigments in a batch mode, at an intensity greater than "fluid energy" dispersers can achieve, but in an easier and less complex manner than "mechanical energy" shot mills provide. The present invention provides such a disperser. Other features and advantages of the present invention will become apparent upon a reading of the attached specification in combination with a study of the drawings.

OBJECTS AND SUMMARY OF THE INVENTION

A general object of the present invention is to provide a dispersing apparatus used to grind pigments in a batch mode, at an intensity which is greater than "fluid energy" dispersers can accomplish, and in an easier and less complex manner than "mechanical energy" shot mills can accomplish.

Another general object of the present invention is to provide a dispersing apparatus including an assembly having rollers which advance under shaft rotation and roll over a wet film of solids suspended in a liquid.

An object of the present invention is to provide a roller-stator disperser in which roller to stator dynamic pressure can be increased or decreased.

A further object of the present invention is to provide a roller assembly for a roller-stator disperser which allows the rollers to be positioned against or away from the stator assembly as a result of the viscosity/rheology of the slurry being processed.

Yet an even further object of the present invention is to provide a roller assembly for a roller-stator disperser which allows the rollers to move as they wear during use.

An even further object of the present invention is to provide a roller-stator disperser which uses a deflector to create pumping with a mixing vessel.

Briefly, and in accordance with the foregoing, the present invention discloses an apparatus for dispersing solid particles carried in suspension in a liquid medium. The apparatus includes a mounting frame, a rotatable agitator shaft connected thereto, a motor drive assembly carried thereby for rotating the agitator shaft, and a roller-stator assembly carried by the mounting frame. The roller-stator assembly includes a roller assembly and a stator assembly.

The stator assembly includes a plurality of stator support rods extending from the mounting frame and a stator ring attached to the stator support rods. The roller assembly is connected to the agitator shaft and is positioned within the stator ring.

The roller assembly includes a plurality of upper and lower support portions which form pairs and each of which has a roller positioned therebetween which is rotatable with respect to the pair and with respect to the stator ring. The upper and lower support portions can be affixed to the agitator shaft at the same angle relative thereto or at varying angles relative thereto. The upper and lower support portions have slots therein in which the respective roller is mounted such that the roller can move inwardly and outwardly relative to the agitator shaft. Such inward and outward motion can be radial.

A deflector is mounted below the stator ring such that when material passes through the stator ring, the material encounters the deflector and is recirculated for another pass through the disperser. The deflector can include vertical fins protruding upwardly therefrom to create pumping within the mixing vessel.

In a second embodiment, the stator ring includes a plurality of spaced apart members on an inner surface thereof. Each roller has a plurality of teeth which are capable of intermeshing with the spaced apart members as the roller assembly rotates relative to the stator assembly.

In addition, the stator ring can be provided with a plurality of venturi openings therethrough for allowing material to pass therethrough during dispersion.

In yet another embodiment, each roller can be provided with a tapered outer wall. Means for varying the position of the stator assembly relative to the roller assembly can be provided such that varying amounts of each said roller is in contact with the stator ring.

Other objects of the present invention will become apparent upon a reading of the attached specification in combination with a study of the drawings.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
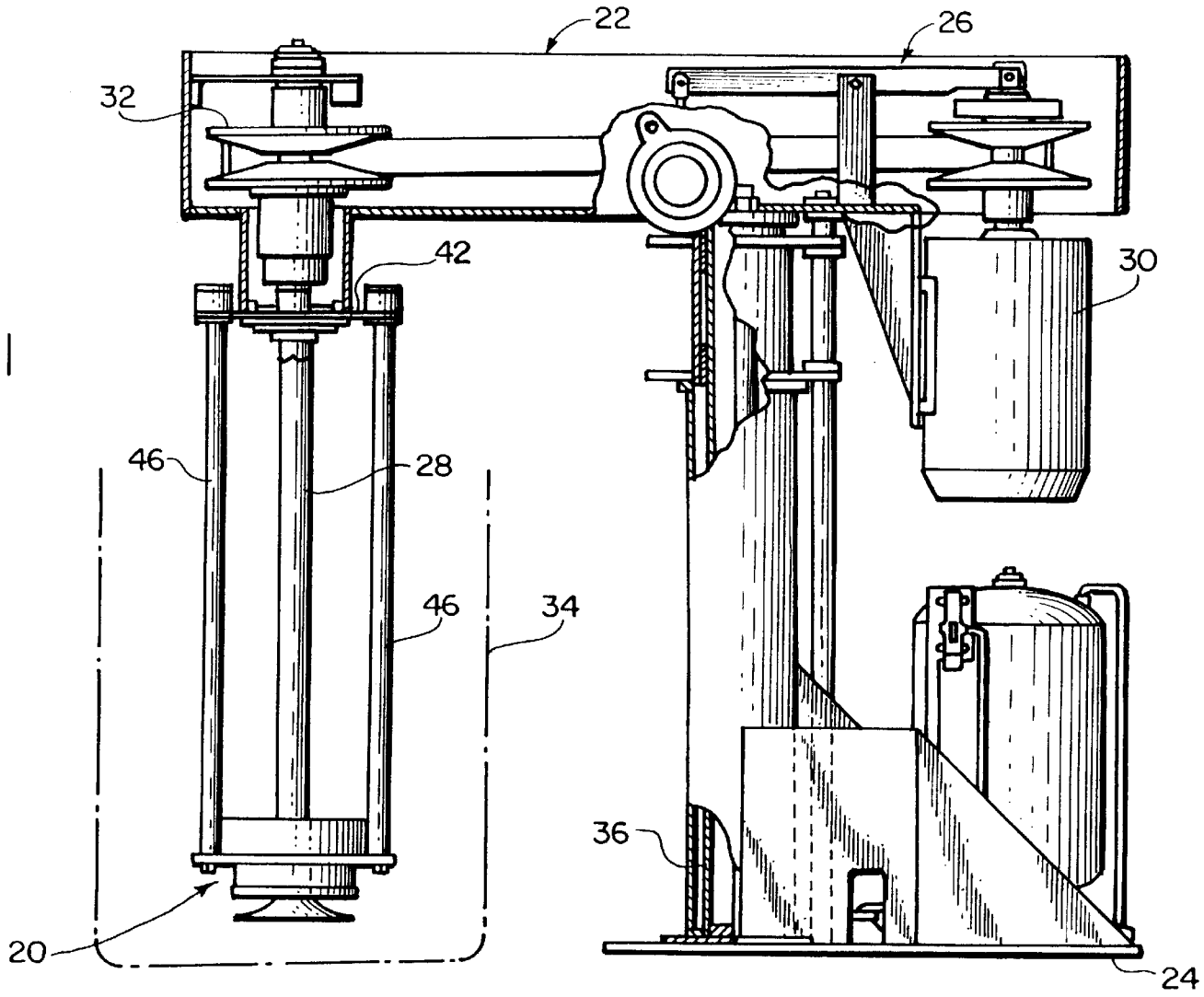
FIG. 1 is a side elevational view, shown partially in cross-section, of a dispersing apparatus which incorporates the features of the invention.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

The roller-stator assembly, generally denoted as reference numeral 20, which incorporates the features of the present invention is used in a dispersing apparatus 22 to grind pigments in a batch mode, at an intensity which is greater than what "fluid energy" dispersers can accomplish, and in an easier and less complex manner than "mechanical energy" shot mills can accomplish. The roller-stator assembly 20 of the present invention bolts to a high speed disperser or can be attached to a rotor stator.

Figure 2:
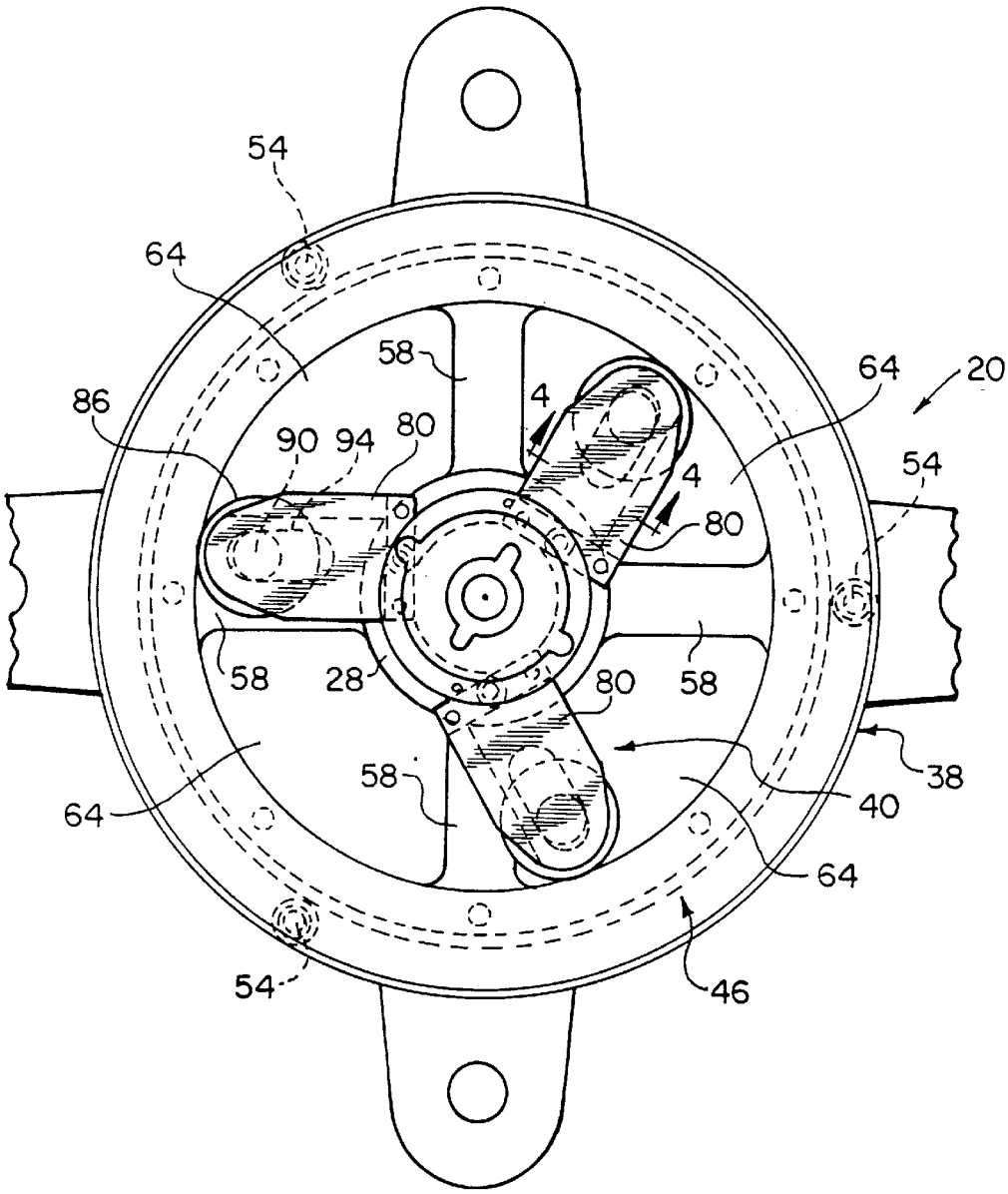
FIG. 2 is a top plan view of a roller-stator assembly which incorporates the features of a first embodiment of the invention.
Figure 3:
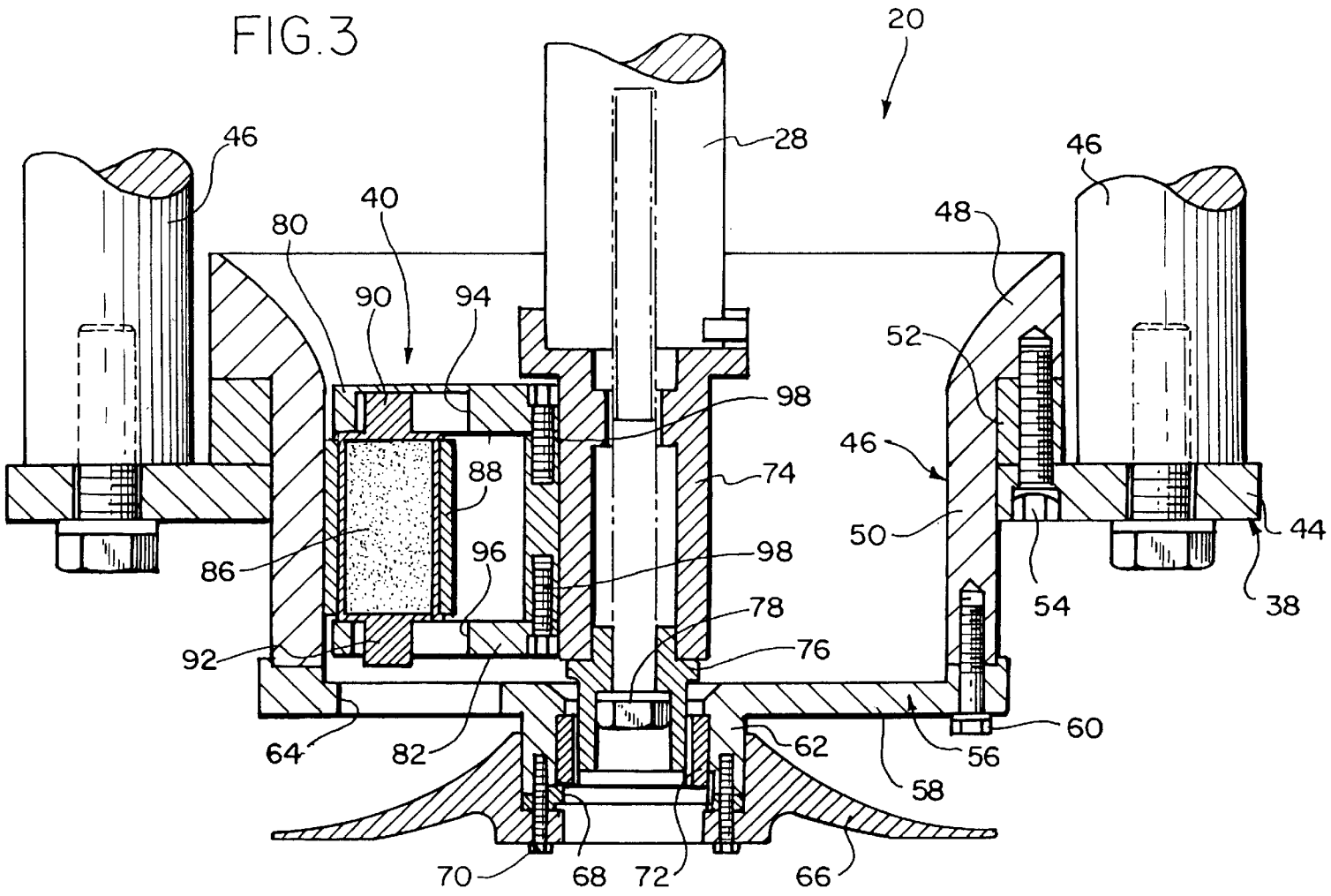
FIG. 3 is a cross-sectional view of the roller-stator assembly of FIG. 2.
Figure 4:
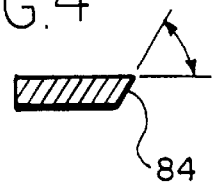
FIG. 4 is a cross-sectional view along line 4—4 of FIG. 2.
Figure 5:
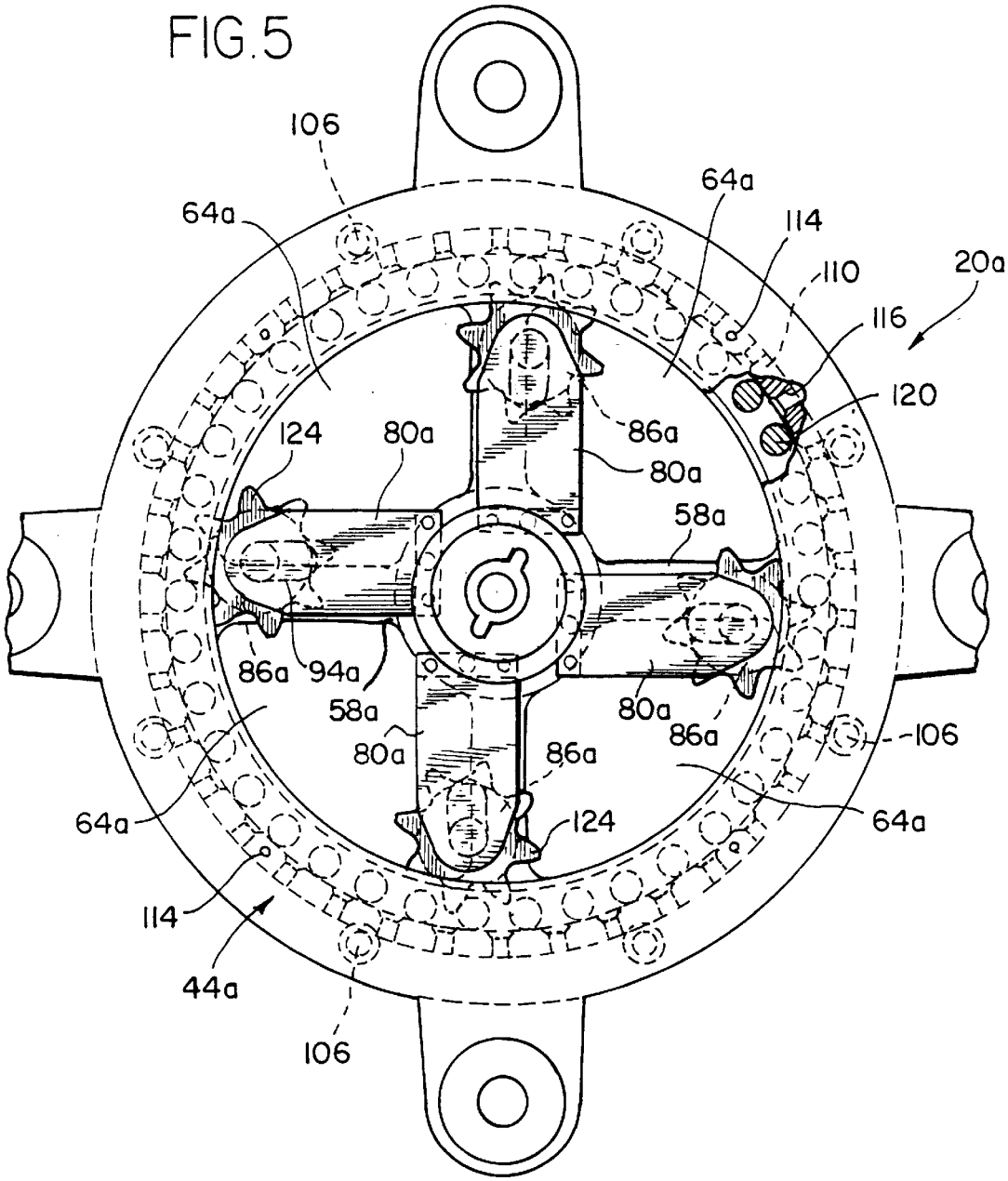
FIG. 5 is a top plan view, shown partially in cross-section, of a roller-stator assembly which incorporates the features of a second embodiment of the invention.
Figure 6:
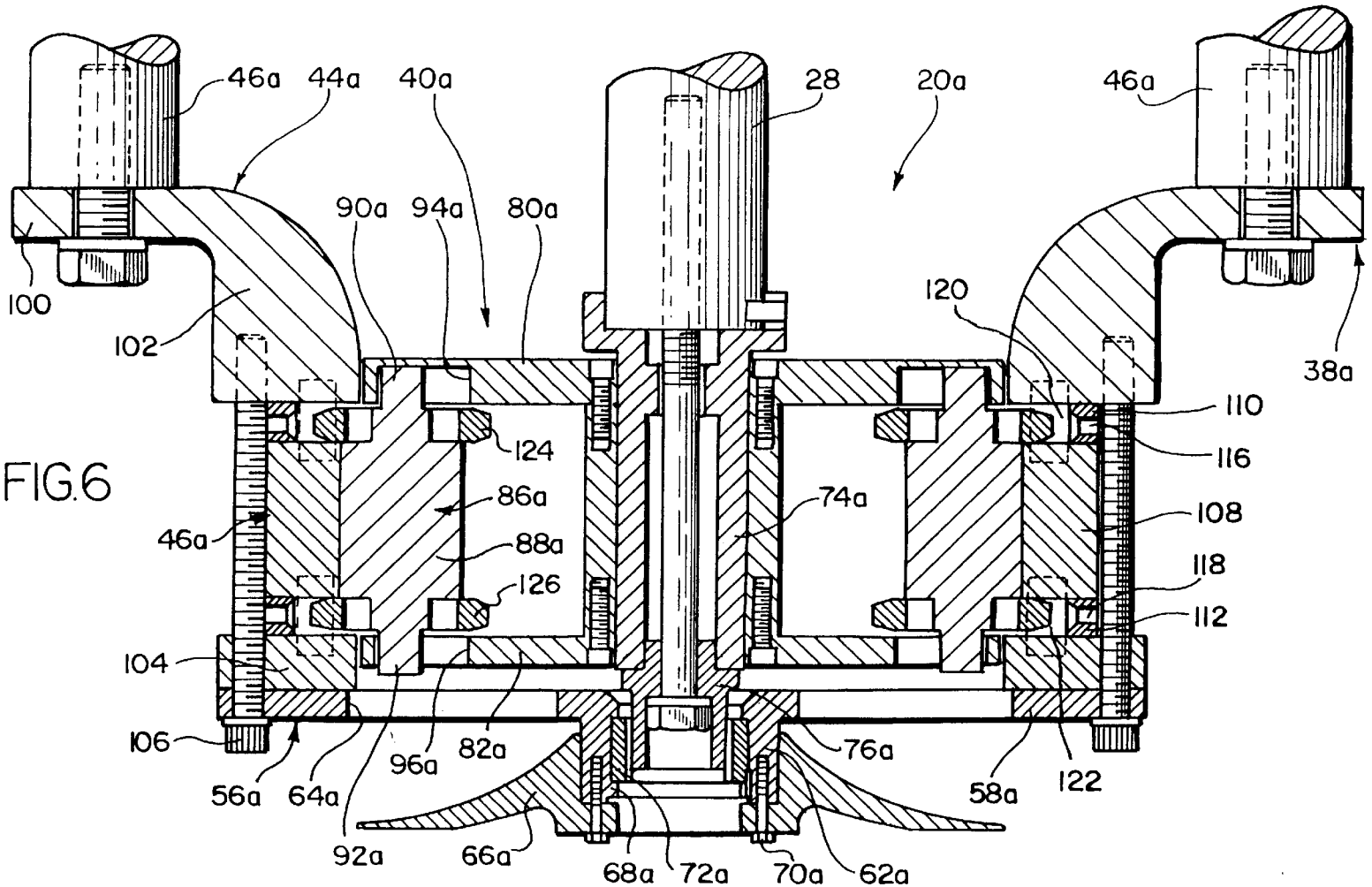
FIG. 6 is a cross-sectional view of the roller-stator assembly of FIG. 5.
Figure 8:
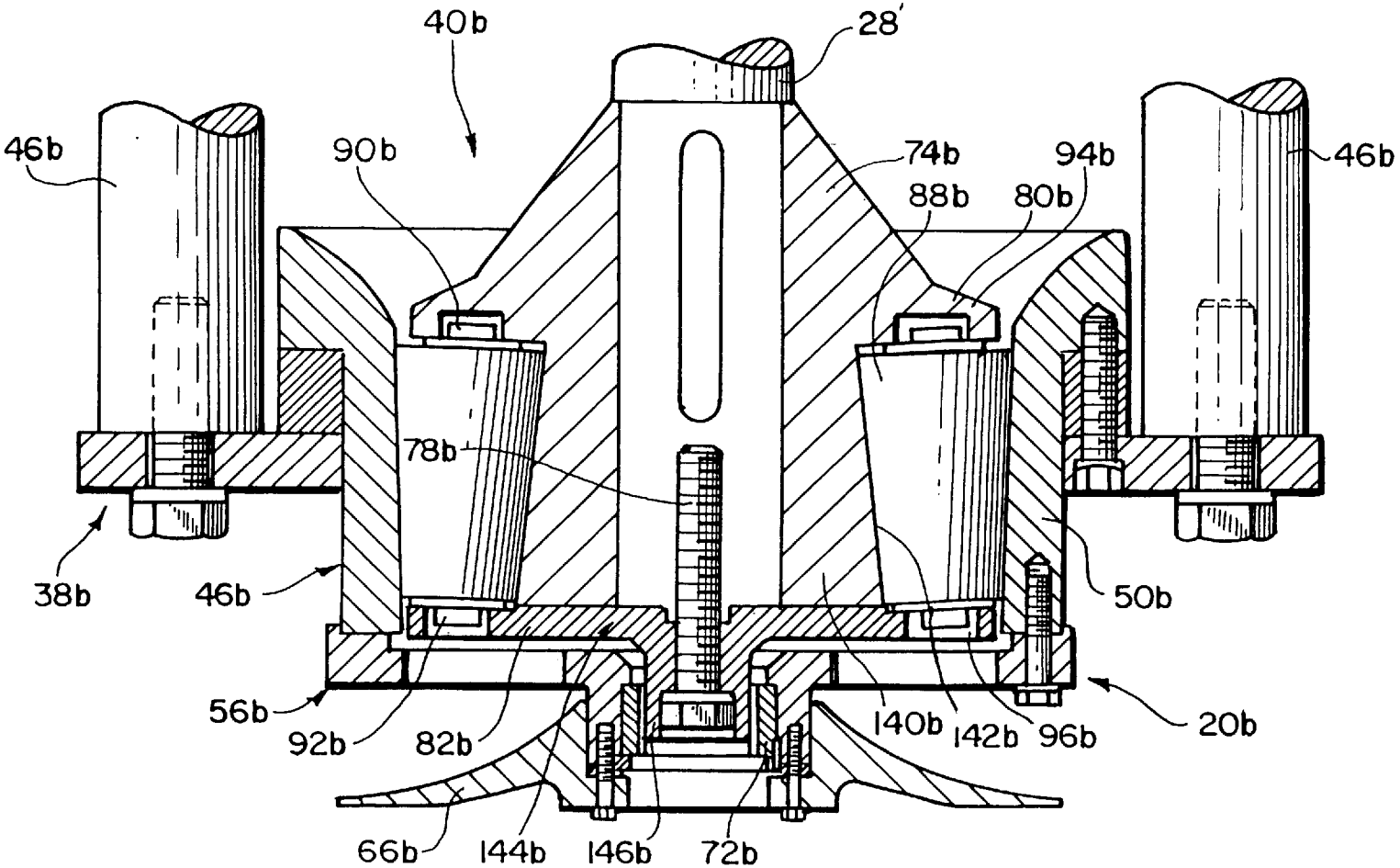
FIG. 8 is a top plan view of a roller-stator assembly which incorporates the features of a third embodiment of the invention.
Figure 9:
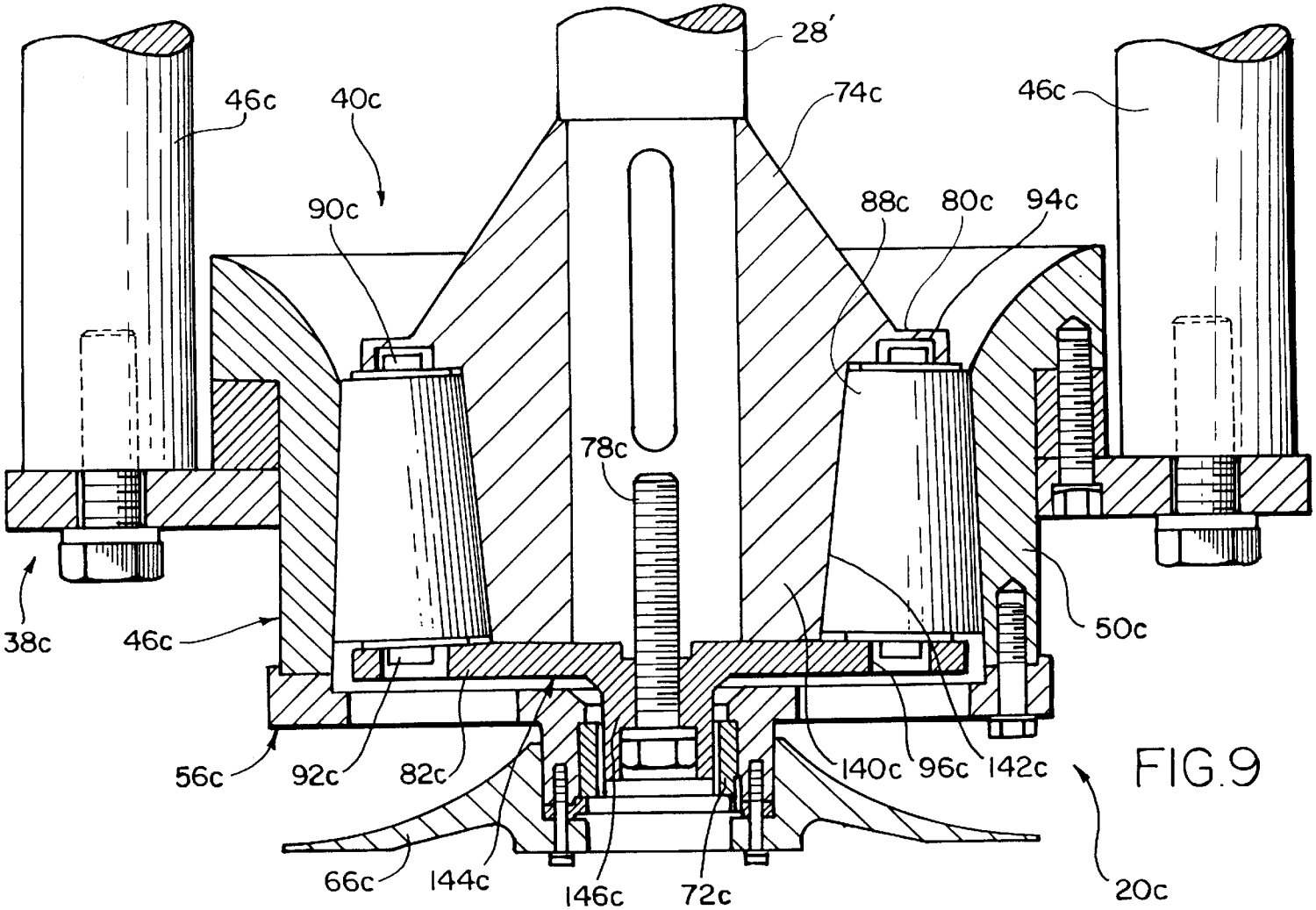
FIG. 9 is a top plan view of a roller-stator assembly which incorporates the features of a fourth embodiment of the invention.
Figure 10:
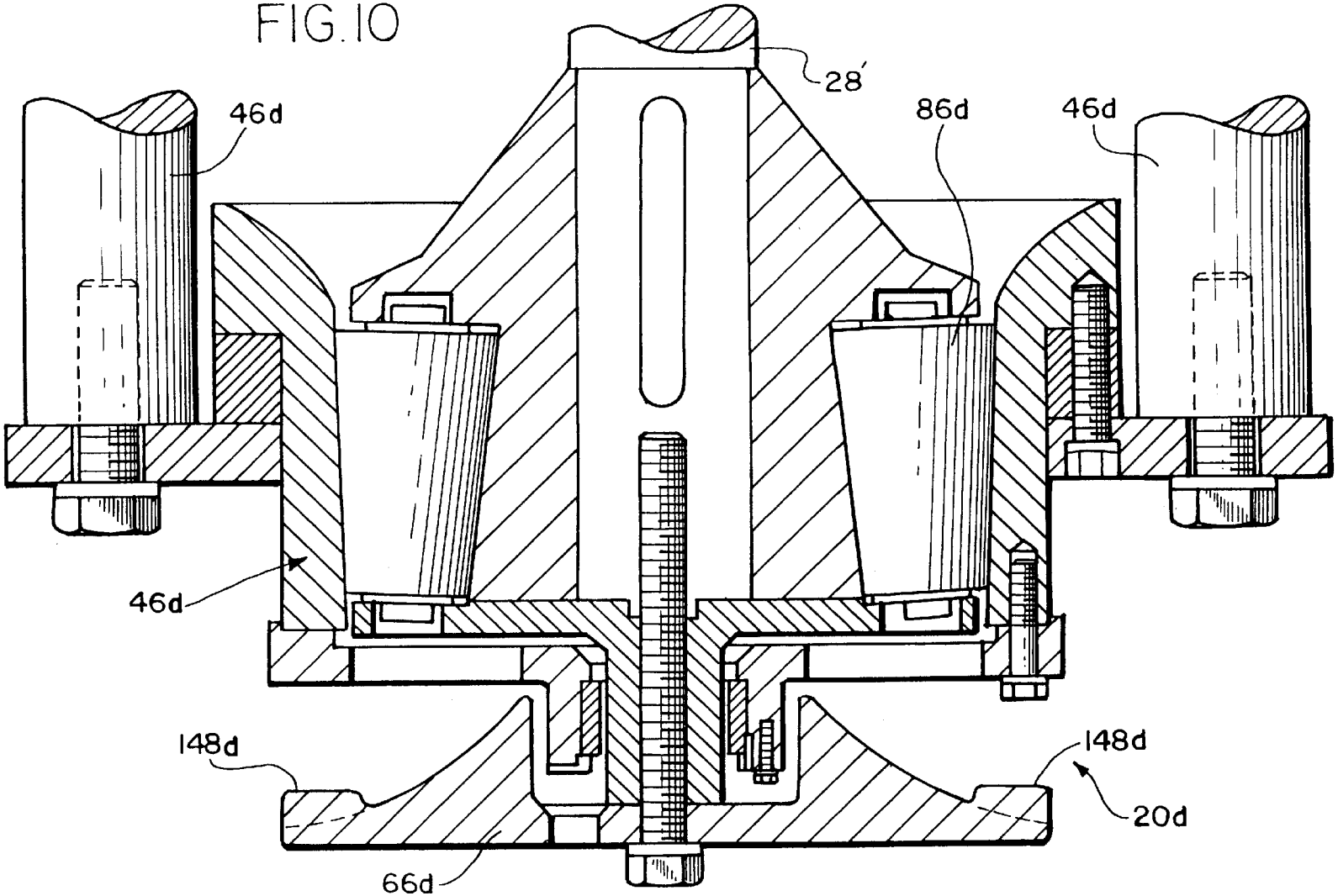
FIG. 10 is a top plan view of a roller-stator assembly which incorporates the features of a fifth embodiment of the invention.
Figure 11:
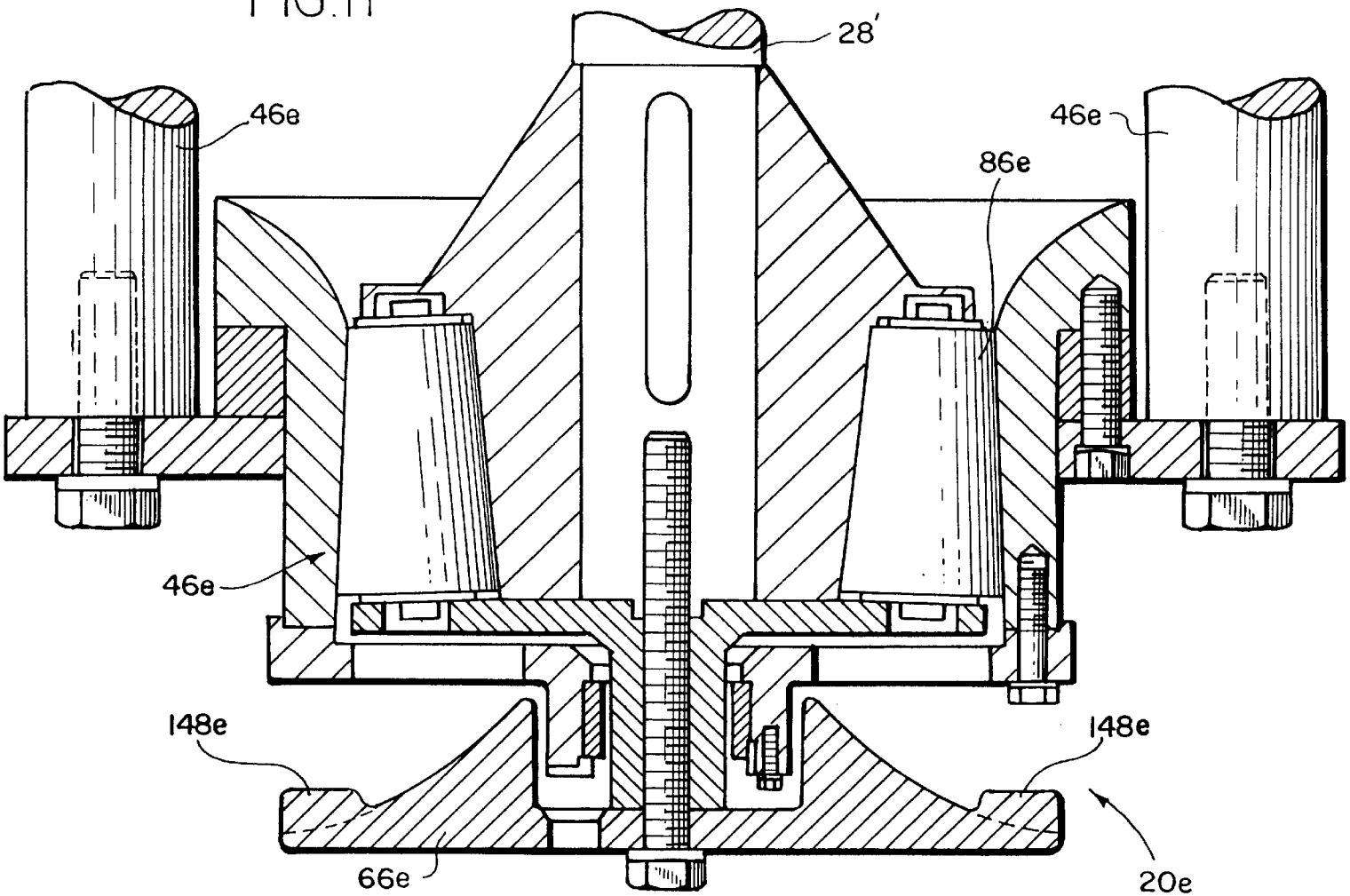
FIG. 11 is a top plan view of a roller-stator assembly which incorporates the features of a sixth embodiment of the invention.

A first embodiment of the roller-stator assembly 20 is shown in FIGS. 2–4. A second embodiment of the roller-stator assembly 20*a* is shown in FIGS. 5 and 6. Third and fourth embodiments of the roller-stator assembly 20*b*, 20*c* are shown in FIGS. 8 and 9, respectively; and firth and sixth embodiments of the roller-stator assembly 20*d*, 20*e* are shown in FIGS. 10 and 11, respectively. Like elements in each embodiment are denoted with like reference numerals, with the like elements of the second embodiment being denoted with the suffix "a" after the reference numeral, like elements of the third embodiment being denoted with the suffix "b" after the reference numeral, like elements of the fourth embodiment being denoted with the suffix "c" after the reference numeral, like elements of the fifth embodiment being denoted with the suffix "e" after the reference numeral, and like elements of the sixth embodiment being denoted with the suffix "e" after the reference numeral.

FIG. 1 shows the roller-stator assembly 20 of FIGS. 2–4 mounted to a dispersing apparatus 22. While the roller-stator assembly 20 of FIGS. 2–4 is shown mounted to the dispersing apparatus 22, it is to be understood that any of the embodiments of the roller-stator 20*a*, 20*b*, 20*c*, 20*d*, 20*e* shown in FIGS. 2–6 and 8–11 can be mounted on the dispersing apparatus 22 shown in FIG. 1 in a like manner. The dispersing apparatus 22 shown in FIG. 1 includes a mounting frame 24, a motor drive assembly 26, and an agitator shaft 28 connected to the motor drive assembly 26. The motor drive assembly 26 may include a variable speed motor 30 for driving the agitator shaft 28 through a belt and variable speed pulley arrangement 32.

The roller-stator assembly 20 of the present invention is connected to a lower end of the agitator shaft 28. The agitator shaft 28 and the roller-stator assembly 20 may be lowered into an operating position in an associated mixing tank 34 shown in phantom line in FIG. 1 by means of an associated hydraulic piston 36 which also forms part of the disperser apparatus 22.

In each embodiment of the roller-stator assembly 20, 20*a*, 20*b*, 20*c*, 20*d*, 20*e*, the agitator shaft 28 is connected to the center of the roller-stator assembly 20, 20*a*, 20*b*, 20*c*, 20*d*, 20*e* and defines a central axis of the roller-stator assembly 20, 20*a*, 20*b*, 20*c*, 20*d*, 20*e* The roller-stator assembly 20, 20*a*, 20*b*, 20*c*, 20*d*, 20*e* includes a stator assembly 38, 38*a*, 38*b*, 38*c*, 38*d*, 38*e* connected to and supported by the mounting frame 24 and a roller assembly 40, 40*a*, 40*b*, 40*c*, 40*d*, 40*e* connected to the lower end of and driven by the agitator shaft 28.

Attention is now invited to the embodiment of the roller-stator assembly 20 shown in FIGS. 2–4.

The stator assembly 38 includes a horizontally positioned, upper stator support plate 42, see FIG. 1, a horizontally positioned, lower stator support plate 44, and a plurality of vertically extending stator support rods 46 interconnecting the upper and lower stator support plates 42, 44. The stator support rods 46 can be airfoil shaped. The upper stator support plate 44 surrounds the agitator shaft 28 and is mounted to the mounting frame 24.

A stator ring 46 is mounted to the lower stator support plate 44 and surrounds the agitator shaft 28. The stator ring 46 includes a circular upper portion 48 and a circular lower portion 50 integrally formed with the upper portion 48 and which depends vertically downward therefrom. The inner wall of the upper portion 48 flares outwardly from the agitator shaft 28 and the inner wall of the lower portion 50 is vertical. In this embodiment, the stator ring 46 is solid and is preferably formed from heavy wall steel tubing or stainless steel tubing.

An annular spacer member 52 is provided between the flared upper portion 48 of the stator ring 46 and the lower stator support plate 44. To mount the stator ring 46 to the lower stator support plate 44, a plurality of screws 54 are provided and extend through the lower stator support plate 44, through the spacer member 52, and into the flared upper portion 48 of the stator ring 46 which overlaps the lower stator support plate 44.

A stator ring plate is secured to the bottom end of the stator ring 46 by suitable means, such as welding. The stator ring plate 56 includes a horizontal upper portion 58 which is connected to the bottom end of the stator ring 46 by a plurality of screws 60 and a vertical lower portion 62 which depends downwardly from the upper portion 58. The upper portion 58 has an aperture through the center thereof which opens into a passageway through the center of the lower portion 62. In addition, a plurality of spaced apart openings 64 are provided through the upper portion 58 of the stator ring plate 56 for reasons described in further detail herein.

A deflector 66 surrounds the lower portion 62 of the stator ring plate 56. The deflector 66 extends outwardly beneath the stator ring plate 56 such that the deflector 66 is beneath, but spaced from, the openings 64 in the stator ring plate 56. An aperture is provided through the center of the deflector 66. The upper surface of the deflector 66 gradually curves downwardly and outwardly from the lower portion 62 of the stator ring plate 56.

An annular plate 68 is mounted between the deflector 66 and the lower portion 62 of the stator ring plate 56. A plurality of screws 70 extend through a center portion of the deflector 66, through the annular plate 68 and into the lower portion 62 of the stator ring plate 56 to mount the deflector 66 to the stator ring plate 56. The position of the deflector 66 relative to the upper portion 58 of the stator ring plate 56 can be adjusted by backing off or tightening the screws 70 to move the deflector 66 away from or towards, respectively, the upper portion 58.

An annular self-lubricating bearing 72 is mounted within the passageway through the lower portion 62 of the stator ring plate 56 for interaction with the roller assembly 40 as described herein and is seated between an inner portion of the annular plate 68 and an inner shoulder of the lower portion 62 of the stator ring plate 56.

The roller assembly 40 includes a roller hub 74 mounted to the lower end of the agitator shaft 28 and a snubber 76 mounted to the bottom end of the roller hub 74. Each of the roller hub 74 and the snubber 76 have a passageway through the center thereof. An elongated screw 78 is seated within the passageways and extends into a bore within the agitator shaft 28 to secure the snubber 76, the roller hub 74 and the agitator shaft 28 together. The head of the screw 78 seats against an inner shoulder of the snubber 76 which protrudes into the snubber central passageway. The lower portion of the snubber 76 extends through the central aperture provided through the stator ring plate 56 and can engage the annular bearing 68.

The roller assembly 40 further includes a plurality of pairs of upper and lower roller support portions 80, 82 which extend horizontally outwardly from the roller hub 74 toward the lower portion 50 of the stator ring 46. As best shown in FIG. 2, three pairs of upper and lower roller support portions 80, 82 are provided. Each upper and lower roller support portion 80, 82 is generally planar and has an angled edge 84 along one side thereof, see FIG. 4. When the roller assembly 40 is rotated, as described herein, the angled side edge 84 provides for an ease of rotation of the roller assembly 40 through the slurry. The upper and lower roller support portions 80, 82 in each pair are spaced apart from each other so that a roller 86 can be mounted between the respective upper and lower roller support portions 80, 82. The pairs of upper and lower roller support portions 80, 82 are separated from each other around the roller hub 74 to define openings therebetween, see FIG. 2.

Each roller 86 has a cylindrical central portion 88 with an upper bearing end 90 at the upper end thereof and a lower bearing end 92 at the lower end thereof. The upper bearing end 90 is mounted within a slot 94 provided within the upper roller support portion 80 and the lower bearing end 92 is mounted within a slot 96 in the lower roller support portion 82 such that each roller 86 is rotatable with respect to its respective upper and lower roller support portions 80, 82.

The upper and lower bearing ends 90, 92 and an outer shell which forms the cylindrical central portion 88 of each roller 86 are formed from brass, steel, carbide, bronze, stainless steel, or other suitable material. A layer of suitable material, such as urethane, TEFLON®, UIIMW plastic, hard chrome plating, or other suitable material, may be coated on the exterior of the cylindrical central shell to control wear on the rollers 86 during repeated use. The cylindrical central portion 88 is filled with lead to weight each roller 86 so that the rollers 86 will move towards and may press against the lower portion 50 of the stator ring 46 as a result of centrifugal force as the roller assembly 40 is rotated by the agitator shaft 28 relative to the stator assembly 38.

Each upper and lower roller support portion 80, 82 is mounted to the roller hub 74 by a pair of screws 98. The upper and lower roller support portions 80, 82 can be pivoted to a desired angle relative to the roller hub 74 and then fixed into the desired place by welds. The angle at which the upper and lower roller support portions 80, 82 can be pivoted relative to the roller hub 84 is limited by the engagement of the opposite inner ends of the upper and lower roller support portions 80, 82 with the exterior surface of the roller hub 74. As shown in FIG. 2, the pair of upper and lower roller support portions 80, 82 are secured at various angles relative to the roller hub 74. This allows for the ability for the rollers 86 and the stator ring 46 to be wedged against each other for substantially more force than what centrifugal force can provide. Depending on the angle at which the upper and lower roller support portions 80, 82 and the roller 86 are positioned relative to the roller hub 74, the roller 86 may move radially outwardly from the roller hub 74.

Now that the specifics of the structure of the roller-stator assembly 20 of FIGS. 2–4 has been described, the method of using the roller-stator assembly 20 for grinding slurry, a liquid medium having solids suspended therein, is described.

The roller-stator assembly 20 is lowered into the mixing vessel 34. The agitator shaft 28 is rotated by the motor drive assembly 26 which rotates the attached roller hub 74, the snubber 76 and the pairs of upper and lower roller support portions 80, 82. Slurry flows into the roller-stator assembly 20 by entering through the upper end of the flared upper portion 48 of the stator ring 46 and downwardly through the openings between the upper roller support portions 80. The rollers 86 advance outwardly from the agitator shaft 28 as a result of centrifugal force and roll over a wet film of suspended solids to grind the solids within the slurry. Excess slurry flows downwardly through the openings between the pairs of upper and lower roller support portions 80, 82 and through the openings 64 in the stator ring plate 56. The excess slurry then flows over the upper surface of the deflector 66, flows upwardly through the mixing vessel 34 and back for another pass through the roller-stator assembly 20 until the desired viscosity/rheology is obtained.

The viscosity/rheology of the slurry may cause the rollers 86 to be spaced from the inner wall of the lower portion 50 of the stator ring 46. The slots 94, 96 in the upper and lower roller support portions 80, 82 of each pair permits the respective roller 86 to move towards or away from the inner wall of the stator ring 46. In addition, the bearing ends 90, 92 and the coating on the rollers 86 will wear over time during use. The slots 94, 96 allow for movement of the rollers 86 as the rollers 86 wear.

Attention is now invited to the second embodiment of the roller-stator assembly **20*a* shown in FIGS. 5 and 6. The roller-stator assembly 20*a* is identical in construction to the roller-stator assembly 20 shown in FIGS. 2–4** except for the differences described herein.

The lower stator support plate **44*a* has an upper portion 100 which is horizontal and a lower portion 102 which depends therefrom and has an inner wall which flares inwardly towards the agitator shaft 28**.

The stator ring plate **56*a* which has an annular spacer plate 104 mounted thereon is attached to and spaced from the lower stator support plate 44*a* by a plurality of spaced-apart elongated screws 106. The upper portion 58*a* of the stator ring plate 56*a* is connected to the lower portion 102 of the lower stator support plate 44*a* by the elongated screws 106 such that the screws 106 extend though passageways in the stator ring plate 56*a* and through the spacer member 104, and into a passageway in the lower portion 102 of the lower stator support plate 44*a***.

The stator ring **46*a* is mounted between the lower portion 102 of the lower stator support plate 44*a* and the stator ring plate 56*a*, and surrounds the agitator shaft 28. The stator ring 46*a* includes an annular central wall portion 108 which has an upper annular ring portion 110 attached thereto at an upper end thereof, and a lower annular ring portion 112 attached thereto at a lower end thereof by suitable means, such as welding. The inner wall of the central wall portion 108 is vertical. The spacer member 104 also forms part of the stator ring 46***a*. The upper and lower annular rings 110, 112 have a width which is less than the width of the central wall portion 108 and are attached to the outer half of the central wall portion 108. The upper ring portion 110 is attached to the lower portion 102 of the lower stator support plate 44*a* by suitable means, such as a plurality of pins 114. The lower ring portion 112 is attached to the stator ring plate 56*a* by suitable means, such as a plurality of pins (not shown). The components forming the stator ring 46*a* are preferably formed from heavy wall steel tubing or stainless steel tubing.

The central wall portion 108 of the stator ring 46*a* is solid. The upper ring portion 110 has a plurality of venturi openings 116 therethrough which are spaced around the circumference thereof. Likewise, the lower ring portion 112 has a plurality of venturi openings 118 therethrough which are spaced around the circumference thereof. The respective upper and lower venturi openings 116, 118 are vertically aligned with each other. The function of these venturi openings 116, 118 will be described in detail herein.

As discussed, the upper and lower rings 110, 112 are attached to the outer half of the central wall portion 108. A plurality of spaced apart pins 120, which also form a portion of the stator ring 46*a*, are mounted between the inner half of the central wall portion 108 and the bottom end of the lower portion 102 of the lower stator support plate 44*a*. The pins 120 and the venturi openings 110 alternate around the circumference of the stator ring 46*a* such that the pins 120 do not block the venturi openings 110, see FIG. 5. Likewise, a plurality of spaced apart pins 122, which also form a portion of the stator ring 46*a*, are mounted between the inner half of the central wall portion 108 and the upper portion 58*a* of the stator ring plate 56*a*. The pins 122 and the venturi openings 112 alternate around the circumference of the stator ring 46*a* such that the pins 122 do not block the venturi openings 112.

Each roller 86*a* of the roller assembly 40*a* has a cylindrical central portion 868*a* with an upper bearing end 90*a* at the upper end thereof and a lower bearing end 92*a* at the lower end thereof. Identical to that of the embodiment shown in FIGS. 2–4, the upper bearing end 90*a* is seated within a slot 94*a* provided within the upper roller support portion 80*a* and the lower bearing end 92*a* is seated within a slot 96*a* in the lower roller support portion 82*a* such that each roller 86*a* is rotatable with respect to its respective upper and lower roller support portions 80*a*, 82*a*. As shown in FIG. 5, four rollers 86*a* are provided, such that four pairs of upper and lower roller support portions 80*a*, 82*a* are provided. A plurality of tooth sprockets 124 are provided at the upper end of the cylindrical central portion 88*a* which protrude outwardly therefrom. A plurality of tooth sprockets 126 are provided at the lower end of the cylindrical central portion 88*a* which protrude outwardly therefrom. The upper tooth sprockets 124 engage against the upper pins 120 and the lower tooth sprockets 126 engage against the lower pins 122 as the roller assembly 40*a* rotates relative to the stator assembly 38*a*.

The upper and lower bearing ends 90*a*, 92*a*, the tooth sprockets 124, 126, and an outer shell which forms the cylindrical central portion 88*a* of each roller 86*a* are formed from brass, steel, carbide, bronze, stainless steel, or other suitable material. A layer of suitable material, such as urethane, TEFLON®, UIIMW plastic, hard chrome plating, or other suitable material, may be coated on the exterior of the cylindrical central shell to control wear on the rollers 86 during repeated use. The cylindrical central portion 88*a* is filled with lead to weight each roller 86*a* so that the rollers 86*a* will move towards and may press against the central wall portion 108 of the stator ring 46*a* as a result of centrifugal force as the roller assembly 40*a* is rotated by the agitator shaft 28 relative to the stator assembly 38*a*.

Now that the specifics of the structure of the roller-stator assembly 20*a* of FIGS. 5 and 6 has been described, the method of using the roller-stator assembly 20*a* for grinding slurry is described.

The roller-stator assembly 20*a* is lowered into the mixing vessel 34. The agitator shaft 28 is rotated which rotates the attached roller hub 74*a*, the snubber 76*a* and the pairs of upper and lower roller support portions 80*a*, 82*a*. Slurry flows into the roller-stator assembly 20*a* by entering through the flared lower portion 102 of the lower stator support plate 44*a*. The slurry flows downwardly through the openings between the upper roller support portions 80*a*. The rollers 86*a* advance outwardly from the agitator shaft 28 as a result of centrifugal force and roll over a wet film of suspended solids to grind the solids within the slurry. The upper tooth sprockets 124 engage with the upper pins 120 and the lower tooth sprockets 126 engage with the lower pins 122, as the roller assembly 40*a* rotates within the stator assembly 38*a*. The engagement of the tooth sprockets 124, 126 and the pins 120, 122 prevents the rollers 86*a* from skidding relative to the inner wall of the stator ring 46*a*. Slurry flows outwardly from the stator ring 46*a* through the venturi openings 116, 118 in the upper and lower rings 110, 112 to promote mixing. Excess slurry flows downwardly through the openings between the lower roller support portions 82*a* and through the openings 64*a* in the stator ring plate 56*a*. The excess slurry flows over the upper surface of the deflector 66*a*, flows upwardly through the mixing vessel 34 and back for another pass through the roller-stator assembly 20*a* until the desired viscosity/rheology is obtained.

The viscosity/rheology of the slurry may cause the rollers 86*a* to be spaced from the inner wall of the stator ring 46*a*. The slots 94*a*, 96*a* permits the respective roller 86*a* to move towards or away from the inner wall of the stator ring 46*a*. In addition, the tooth sprockets 124, 126, the bearing ends 90*a*, 92*a* and the coating on the rollers 86*a* will wear over time during use. The slots 90*a*, 92*a* allow for movement of the rollers 86*a* as the rollers 86*a* wear during use.

Figure 7:
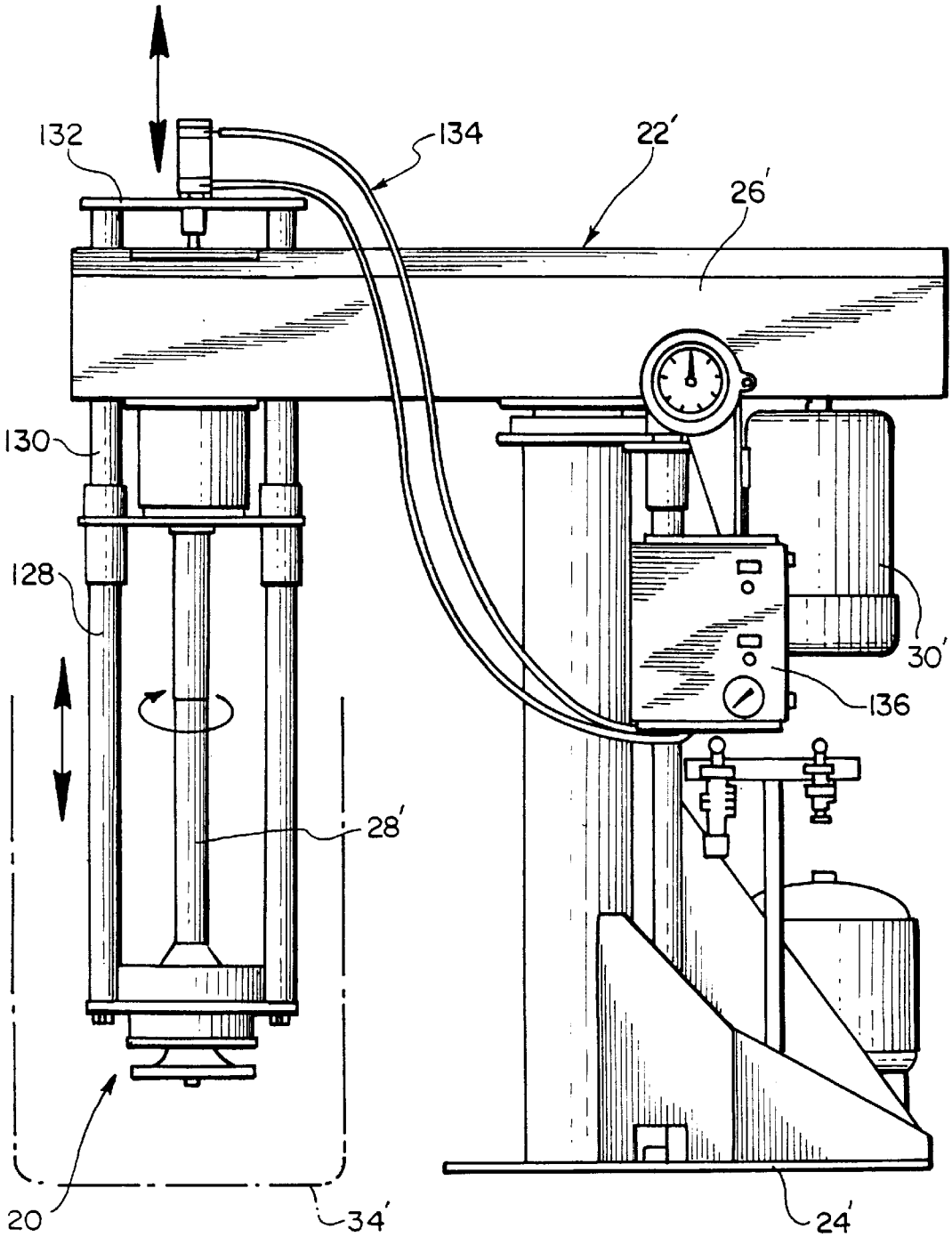
FIG. 7 is a side elevational view, shown partially in cross-section, of a dispersing apparatus which incorporates the features of the invention.

Attention is now invited to FIG. 7. While the roller-stator assembly 20*d* of FIG. 10 is shown mounted to the dispersing apparatus 22' of FIG. 7, it is to be understood that any of the embodiments of the roller-stator 20, 20*b*, 20*c*, 20*e* shown in FIGS. 2–3 and 8–11 can be mounted on the dispersing apparatus 22' shown in FIG. 7. The dispersing apparatus 22' shown in FIG. 7 includes a mounting frame 24', a motor drive assembly 26', and an agitator shaft 28' connected to the motor drive assembly 26'. The motor drive assembly 26' may include a variable speed motor 30' for driving the agitator shaft 28' through a belt and variable speed pulley arrangement (not shown).

As illustrated, the roller-stator assembly 20*d* is connected to a lower end of the agitator shaft 28'. The agitator shaft 28' and the roller-stator assembly 20*d* may be lowered into an operating position in an associated mixing tank 34' shown in phantom line in FIG. 7 by means of an associated hydraulic piston (not shown) which also forms part of the disperser apparatus 22'.

In each embodiment of the roller-stator assembly 20*b*, 20*c*, 20*d*, 20*e*, the agitator shaft 28' is connected to the center of the roller-stator assembly 20*b*, 20*c*, 20*d*, 20*e* and defines a central axis of the roller-stator assembly 20*b*, 20*c*, 20*d*, 20*e*. The roller-stator assembly 20*b*, 20*c*, 20*d*, 20*e* includes a stator assembly 38*b*, 38*c*, 38*d*, 38*e* connected to and supported by the mounting frame 24' and a roller assembly 40*b*, 40*c*, 40*d*, 40*e* connected to the lower end of and driven by the agitator shaft 28'. The stator assembly 38*b*, 38*c*, 38*d*, 38*e* of each roller-stator assembly 20*b*, 20*c*, 20*d*, 20*e* shown in FIGS. 8–11 is identical in construction to the stator assembly 38 shown in FIGS. 2–4 except for the differences described herein.

In each of the embodiments shown in FIGS. 8–11, each stator support rod 46*b*, 46*c*, 46*d*, 46*e* includes a lower portion 128 and an upper portion 130 which are telescoped together. The lower and upper portions 128, 130 can be extended to lengthen the overall length of the stator support rods 46*b*, 46*c*, 46*d*, 46*e*, or can be retracted to shorten the overall length of the stator support rods 46*b*, 46*c*, 46*d*, 46*e*. The upper portion 130 of each stator support rod 46*b*, 46*c*, 46*d*, 46*e* is attached to a plate 132 which is connected to a moving means 134. The telescoping function of the stator support rods 46*b*, 46*c*, 46*d*, 46*e* can be effected by pneumatic operation using a compressed air source 136, as shown, hydraulic operation using a hydraulic power pack, by a lever from below the machine, or by other suitable means. When telescoped, the stator assembly 38*b*, 38*c*, 38*d*, 38*e* can be completely separated from the respective roller assembly 40*b*, 40*c*, 40*ed* 40*e*, partially engaged with the respective roller assembly 40*b*, 40*c*, 40*d*, 40*e* such that the respective rollers 86*b*, 86*c*, 86*d*, 86*e* are partially engaged with respective stator ring 46*b*, 46*c*, 46*d*, 46*e*, or completely engaged with the respective roller assembly 40*b*, 40*c*, 40*d*, 40*e* such that the respective rollers 86*b*, 86*c*, 86*d*, 86*e* are completely engaged with the respective stator ring 46*b*, 46*c*, 46*d*, 46*e*.

Attention is now specifically invited to the embodiment of the roller-stator assembly 20*b* shown in FIG. 8.

With regard to the stator assembly 38*b*, the inner wall 50*b* of the lower portion of the stator ring 46*b* tapers inwardly relative the central axis of the agitator shaft 28' as it extends downwardly.

The roller assembly 38*b* includes a roller hub 74*b* mounted to the bottom end of the agitator shaft 28'. The roller hub 74*b* has a central portion 140*b* which has a passageway through the center thereof. The agitator shaft 28' is mounted within the passageway of the central portion 140*b* and the uppermost end of the central portion 140*b* abuts against a shoulder on the agitator shaft 28'. The outer wall 142*b* of the central portion 140*b* tapers inwardly relative the central axis of the agitator shaft 28' from its top end to its bottom end. A plurality of pairs of upper roller support portions 80*b* are integrally formed with the central portion 140*b* of the roller hub 74*b* and extend horizontally outwardly from the central portion 140*b* toward the stator ring 46*b*. Each upper roller support portion 80*b* has a slot 94*b* therein in which the upper bearing end 90*b* of an associated roller 86*b* is seated.

The roller hub 74*b* is seated on a plate 144*b* which has an aperture through the center thereof. The plate 144*b* includes a lower annular portion 146*b* and has a plurality of pairs of lower roller support portions 82*b* which extend horizontally outwardly from the lower annular portion 146*b* toward the stator ring 46*c*. The lower annular portion 146*b* extends downwardly into the central aperture provided in the stator ring plate 56*b* of the stator assembly 38*b*. The lower annular portion 146*b* can engage the annular bearing 72*b*. Each lower roller support portion 82*b* has a slot therethrough in which the lower bearing end 92*b* of an associated roller 86*b* is seated.

A screw 78*b* extends through the passageway in the lower annular portion 146*b* and extends into a passageway in the agitator shaft 28' to secure the plate 144*b*, the roller hub 74*b* and the agitator shaft 28' together. The roller hub 74*b* is sandwiched and securely held in position between the plate 144*b* and a shoulder on the agitator shaft 28'. The head of the screw 78*b* seats against an inner shoulder of the plate 144*b* which protrudes into the central passageway thereof.

The upper and lower roller support portions 80*b*, 82*b* are generally planar and have an angled edge along one side thereof, like that of the embodiment of FIGS. 2–4. The upper and lower roller support portions 80*b*, 82*b* are formed in pairs and each pair is spaced apart from each other so that a roller 86*b* can be mounted therebetween. The pairs of upper and lower roller support portions 80*b*, 82*b* are separated from each other around the central portion of the roller hub 74*b* to define openings therebetween.

Each roller 86*b* has a central portion 88*b* which tapers inwardly relative to the center of the roller 86*b* from its upper end to its lower end. The upper and lower bearing ends 90*b*, 92*b* of each roller 86*b* are mounted within the slots 94*b*, 96*b* provided within the respective pair of upper and lower roller support portions 80*b*, 82*b* such that the roller 86*b* is rotatable with respect to its respective upper and lower roller support portions 80*b*, 82*b*.

The upper and lower bearing ends 90*b*, 92*b* and an outer shell which forms the central portion 88*b* of each roller 86*b* are formed from brass, steel, carbide, bronze, stainless steel, or other suitable material. A layer of suitable material, such as urethane, TEFLON®, UIIMW plastic, hard chrome plating, or other suitable material, may be coated on the exterior of the central shell to control wear on the rollers 86*b* during repeated use. The central portion 88*b* is filled with lead to weight each roller 86*b* so that the rollers 86*b* will move towards and may press against the lower portion 50*b* of the stator ring 46*b* as a result of centrifugal force as the roller assembly 40*b* is rotated by the agitator shaft 28' relative to the stator assembly 38*b*.

Attention is now specifically invited to the embodiment of the roller-stator assembly 20*c* shown in FIG. 9. This embodiment is identical to the embodiment shown in FIG. 8, except for the differences noted herein.

With regard to the stator assembly 38*c*, the inner wall of the lower portion 50*c* of the stator ring 46*c* tapers outwardly relative the central axis of the agitator shaft 28' as it extends downwardly.

With regard to the roller assembly 40*c*, the outer wall 142*c* of the central portion 140*c* tapers inwardly relative to the central axis of the agitator shaft 28' from its top end to its bottom end. The central portion 88*c* of each roller 86*c* tapers outwardly relative to the center of the roller 86*c* from its upper end to its lower end.

FIG. 10 is identical in construction to FIG. 8 and FIG. 11 is identical in construction to FIG. 9 except for the construction of the deflector 66*d*, 66*e* in each embodiment.

In FIGS. 10 and 11, the deflector 66*d*, 66*e* includes a plurality of vertical fins or vanes 148*d*, 148*e* which extend upwardly from the upper surface thereof to create a dynamic deflector. The vertical fins or vanes 148*d*, 148*e* extend upwardly from the outer edge of the upper surface of the deflector 66*d*, 66*e* and are spaced from each other around the outer edge of the deflector 66*d*, 66*e*. The fins or vanes 148*d*, 148*e* create pumping to help in circulating the slurry within the mixing tank 34'. The deflector 66, 66*a*, 66*b*, 66*c* of FIGS. 2–6, 8 and 9 is a static deflector.

In each of the embodiments of FIGS. 8–11, because the amount of contact between the rollers 86*b*, 86*c*, 86*d*, 86*e* and the stator ring 46*b*, 46*c*, 46*d*, 46*e* can be modified, roller to stator dynamic pressure can be increased or decreased as desired. The more contact between the rollers 86*b*, 86*c*, 86*d*, 86*e* and the stator ring 46*b*, 46*c*, 46*d*, 46*e*, the more pressure is created which creates additional force. In addition, because of the tapered shape of the rollers 86*b*, 86*c*, 86*d*, 86*e* in each of the embodiments of FIGS. 8–11, the rollers 86*b*, 86*c*, 86*d*, 86*e* will dynamically drive axially or on their own and load a specific wear area. This wear area can be toughened up with suitable bearing material, such as urethane, TEFLON®, UIIMW plastic, hard chrome plating, or other suitable material.

While preferred embodiments of the present invention are shown and described, it is envisioned that those skilled in the art may devise various modifications of the present invention without departing from the spirit and scope of the appended claims.

The invention claimed is:

1. An apparatus for dispersing solid particles carried in suspension in a liquid medium comprising:

a mounting frame;

a rotatable agitator shaft connected to said mounting frame;

a drive assembly carried by said mounting frame for rotating said agitator shaft;

a stator assembly carried by said mounting frame, said stator assembly including a plurality of stator support rods extending from said mounting frame, and a stator ring attached to said stator support rods; and a roller assembly connected to said agitator shaft and positioned within said stator ring, said roller assembly being rotatable with respect to said stator ring to roll over a slurry of solid particles suspended in a liquid medium.

2. An apparatus as defined in claim 1, further including a horizontally disposed deflector operatively mounted below said roller assembly.

3. An apparatus as defined in claim 2, wherein said deflector includes vertical fins protruding upwardly from said deflector.

4. An apparatus as defined in claim 1, wherein said roller assembly including at least one upper roller support portion connected to said agitator shaft and at least one lower roller support portion connected to said agitator shaft and a roller positioned between each said upper roller support portion and said lower roller support portion, each said upper roller support portion and each said lower roller support portion having a slot therein in which said roller is mounted such that said roller can move inwardly and outwardly relative to said agitator shaft.

5. An apparatus as defined in claim 4, wherein each said upper and lower roller support portion is generally planar and has an angled side edge.

6. An apparatus as defined in claim 4, wherein a plurality of pairs of upper and lower roller support portions are connected to said agitator shaft, each said pair of upper and lower roller support portions being separated from the adjacent pair of upper and lower roller support portions.

7. An apparatus as defined in claim 6, wherein each said pair of upper and lower roller support portions are affixed to said agitator shaft at the same angle relative to said agitator shaft.

8. An apparatus as defined in claim 7, wherein said pair of upper and lower roller support portions are affixed to said agitator shaft at varying angles relative to said agitator shaft.

9. An apparatus as defined in claim 1, wherein said stator ring includes a plurality of spaced apart members on an inner surface thereof, and said roller assembly includes at least one roller, each said roller having a plurality of teeth which are capable of intermeshing with said spaced apart members.

10. An apparatus as defined in claim 1, wherein said stator ring includes a plurality of spaced apart upper members at an upper end of an inner surface of said stator ring and a plurality of spaced apart lower members at a lower end of said inner surface of said stator ring, and said roller assembly includes at least one roller, each said roller having a plurality of upper teeth at an upper end thereof which are capable of intermeshing with said spaced apart upper members and a plurality of lower teeth at a lower end thereof which are capable of intermeshing with said spaced apart lower members.

11. An apparatus as defined in claim 1, wherein said stator ring has a plurality of venturi openings therethrough for allowing material to pass therethrough.

12. An apparatus as defined in claim 1, wherein said roller assembly includes at least one roller having a tapered outer wall.

13. An apparatus as defined in claim 12, wherein each said roller has a top end and a bottom end and an outer wall which tapers inwardly relative to a centerline of said roller from its top end to its bottom end.

14. An apparatus as defined in claim 12, wherein each said roller has a top end and a bottom end and an outer wall which tapers outwardly relative to a centerline of said roller from its top end to its bottom end.

15. An apparatus as defined in claim 12, wherein said roller assembly includes at least one roller, and further including means for varying the position of the stator assembly relative to the roller assembly such that varying amounts of each said roller is proximate to said stator ring.

16. An apparatus as defined in claim 1, wherein said roller assembly includes at least one roller, and further including means for varying the position of the stator assembly relative to the roller assembly such that varying amounts of each said roller is proximate to said stator ring.

17. An apparatus as defined in claim 1, wherein said roller assembly includes at least one lead filled roller.

* * * * *